US007207115B2

(12) United States Patent
Otake

(10) Patent No.: US 7,207,115 B2
(45) Date of Patent: Apr. 24, 2007

(54) GLASS-CUTTING APPARATUS

(75) Inventor: Takaaki Otake, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/864,216

(22) Filed: Jun. 9, 2004

(65) Prior Publication Data

US 2004/0244203 A1 Dec. 9, 2004

(30) Foreign Application Priority Data

Jun. 9, 2003 (JP) ..... 2003-163662

(51) Int. Cl.
*B27B 9/00* (2006.01)

(52) U.S. Cl. ..... 30/391; 30/390

(58) Field of Classification Search ..... 30/371, 30/388, 389, 390, 391
See application file for complete search history.

(56) References Cited

U.S. PATENT DOCUMENTS 2,861,607 A 11/1958 Emmons
2,989,995 A * 6/1961 Happe ..... 30/391
3,177,909 A * 4/1965 Laube et al. ..... 30/391
3,266,535 A * 8/1966 Brodie ..... 30/390
3,298,409 A * 1/1967 Elson ..... 83/478
3,456,696 A 7/1969 Gregory et al.
3,701,369 A * 10/1972 Gronke et al. ..... 30/371
3,721,141 A * 3/1973 Frostad ..... 83/478
5,537,748 A 7/1996 Takahashi et al.
5,701,676 A * 12/1997 Itoh ..... 30/388
6,389,701 B1 5/2002 Friedland
2002/0090156 A1 7/2002 Kai et al.

FOREIGN PATENT DOCUMENTS

DE 203 06 563 U1 10/2003
JP 11-310427 11/1999

* cited by examiner

*Primary Examiner*—Hwei-Siu Payer
(74) *Attorney, Agent, or Firm*—Smith, Gambrell & Russell

(57) ABSTRACT

A glass cutting apparatus has a spindle rotatably held and a saw blade provided on the spindle at a tip portion thereof. An upper portion of the blade is covered with a top cover. A lower portion of the blade, which protrudes from a lower portion of the top cover downward, is covered with a swingably safety cover held through a second ball bearing provided at an outer periphery of a bearing case. A fixing member between the bearing case and the blade is provided with a seal cover member which has a tip portion extending to the neighborhood of an outer periphery of a seal member for covering the bearing. Thereby, the seal cover member covers the seal member on a blade side thereof. Thus, the glass-cutting apparatus can eliminate a danger of touching its saw blade by mistake at the time of non-operation.

12 Claims, 6 Drawing Sheets

GLASS-CUTTING APPARATUS

BACKGROUND OF THE INVENTION

1. Field of the Invention

The present invention relates to a glass-cutting apparatus or a glass cutter, and particularly to a glass-cutting apparatus which performs a glass-cutting operation while discharging glass fine particles generated from a cutting glass.

The present application claims priority from Japanese Application No. 2003-163662, the disclosure of which is incorporated herein by reference.

2. Description of the Related Prior Art

Nowadays, as a quantity of industrial wastes increases and begins to exceed a capacity of controlled land fill sites, a reduction of the industrial wastes has become an important problem. Particularly, vehicle window glasses are discarded together with shredder dusts generated by used vehicles, and the quantity of such industrial wastes is enormously large. As for the industrial wastes including the glass, processes of burning the same to take out heat energy have been studied. However, since glass materials can not be easily burnt and are apt to remain as cinders after burning, it causes inconvenience of the need for any further disposal of the cinders. Therefore, some processes of disposing of glasses have been proposed as follows.

Among the glasses, a side door glass is called as a tempered glass, which is broken into grains by hitting it with a hammer, so that the side door glass can be easily collected and discarded. On the other hand, a front glass has a structure in which an intermediate membrane made of resin material is sandwiched between two sheet glasses thereof, and thus it is not easy to break it into fragments. Then, a method of cutting the front glass with a cutting mechanism having a saw blade to discard the cut glass has been proposed (for example, see Japanese Patent Application Laid-Open No. Hei11-310427, in particular FIGS. 3 and 4 thereof).

The cutting mechanism includes the following members: a disc-like diamond cutter mounted on and freely rotated about a central pivot shaft extending sidewardly; a motor for rotationally driving the diamond cutter; a cover for covering an upper portion of the diamond cutter; a stabilizing plate for the cutter mounted on a lower portion of the cover to permit an adjustment of a cut depth in a thickness direction of a front glass through an adjustment of a length by which the diamond cutter protrudes from the under side thereof; and a cooling-water jetting nozzle attached to the cover for downwardly discharging fine particles generated from the front glass cut by the diamond cutter. The cooling-water jetting nozzle is coupled to a high-pressure water supply unit through a tube. For cutting the front glass with the foregoing cutting mechanism, the protrusion of the diamond cutter is adjusted to a certain length by the stabilizing plate, and the diamond cutter is rotationally driven for cutting the front glass, and then water is jetted from the cooling-water jetting nozzle for discharging the fine particles of cut glass downward.

The diamond cutter is protruding from the stabilizing plate for the cutter downward, even under the non-operation. Therefore, there is a danger that an operator touches by mistake on the exposed diamond cutter. Hence, it has been proposed that the cutting mechanism is provided with a safety cover movable between a covering position at which the exposed diamond cutter is covered and a housing position at which the upper portion of diamond cutter is housed in the cover.

However, as the safety cover is so structured that the fine particles generated from the glass in the cutting operation are allowed to enter into a slide space for a central pivot shaft, intrusion of the glass fine particles into the slide space causes a case where the safety cover does not return to the covering position at the time of the non-operation. Thus, there occurs a danger of mistakenly touching the diamond cutter.

SUMMARY OF THE INVENTION

In view of consideration to the foregoing problem, an object of the present invention is to provide a glass-cutting apparatus which does not cause a danger of mistakenly touching the diamond cutter while non-operation.

According to a first aspect of the present invention, there is provided a glass-cutting apparatus comprising a saw blade rotatably held about a central pivot shaft sidewardly extending to cut a glass, a top cover for covering an upper portion of the saw blade, and a safety cover which can swing about the central pivot shaft sidewardly extending to move between a covering position to cover the saw blade downwardly protruding from a lower portion of the top cover and a housing position to receive the saw blade into the top cover. The safety cover is mounted on a bearing disposed about the central pivot shaft, and is permitted to swing through the bearing. Further, clearance between inner and outer rings of the bearing on a side of the saw blade is sealed with a seal member.

The glass-cutting apparatus as stated above allows to swing the safety cover through the bearing, and further a space formed between the inner and outer rings of the bearing on a side of the saw blade thereof is sealed by a seal member, so that the fine particles separated from the glass cut by the saw blade have no intrusion into the neighborhood of the bearing even when the particles go ahead toward the bearing, since the particles are blocked by the seal member. This permits constant free rotational movements of the bearing, and thus an exact movement of the safety cover to the covering position. Thereby, the touch on the saw blade by its operator can be prevented under the non-operation.

In a second aspect of the present invention, the glass-cutting apparatus further comprises a seal cover member for covering the seal member in order to prevent the fine particles generated from the glass to be cut from colliding against the seal member.

According to the glass-cutting apparatus as stated above, a provision of the seal cover member for covering the seal member on the side of the saw blade of the seal member enables to restrict the above-mentioned collision, and thus may prevent an abrasion of the seal member from occurring.

In a third aspect of the present invention, the seal cover member comprises a disc-like covering body section provided between the bearing and the saw blade, and a cover tip section connected to an end of the covering body section and extending toward an outermost periphery of the seal member.

According to the glass-cutting apparatus as stated above, the seal cover member can easily cover the seal member on the side of the saw blade with a simple structure.

In a fourth aspect of the present invention, the seal cover member comprises an attaching section to cover the seal member; the attaching section being attached to the safety cover at a base end side of the seal cover member, and a covering body section extending toward an inside of the attaching section and an innermost periphery of the seal member.

According to the glass-cutting apparatus with the foregoing structure, the seal cover member can easily cover the seal member on the side of the saw blade with the simple structure in the same way as the third aspect of the present invention.

In a fifth aspect of the present invention, the seal cover member may be arranged only in an area having a predetermined circumferential length, in which they are brought into collision against the seal member arranged to the bearing when the fine particles generated from the glass being cut by rotations of the saw blade proceed downward in the top cover.

According to the glass-cutting apparatus with the foregoing structure, the seal cover member may be omitted at a portion where there is no danger of a collision against the seal member. Therefore, the seal cover member can be formed in a compact size.

BRIEF DESCRIPTION OF THE DRAWINGS

These and other objects and advantages of the present invention will become clearly understood from the following description with reference to the accompanying drawings, wherein:

FIGS. 3A and 3B illustrate a top cover of the glass-cutting apparatus, wherein FIGS. 3A, and 3B are side views of a blade case, and a blade cover, respectively;

FIGS. 5A and 5B illustrate a safety cover of the glass-cutting apparatus, wherein FIGS. 5A and 5B are front views of the safety cover under the situation that the blade under a stabilizing plate thereof is covered and exposed, respectively.

DETAILED DESCRIPTION OF THE PREFERRED EMBODIMENTS

Figure 1:
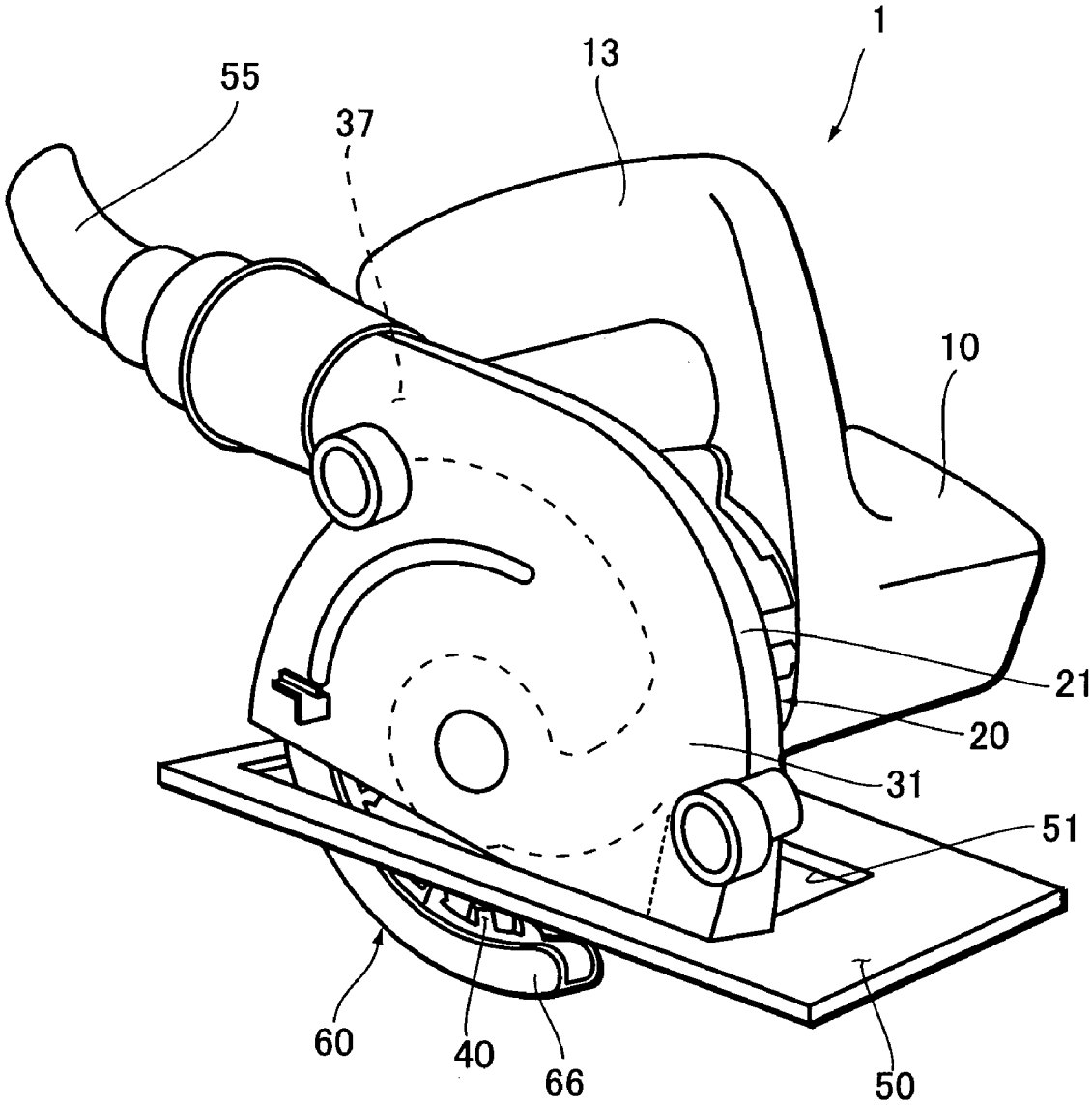
FIG. 1 is a perspective view of a glass-cutting apparatus of the present invention.
Figure 2:
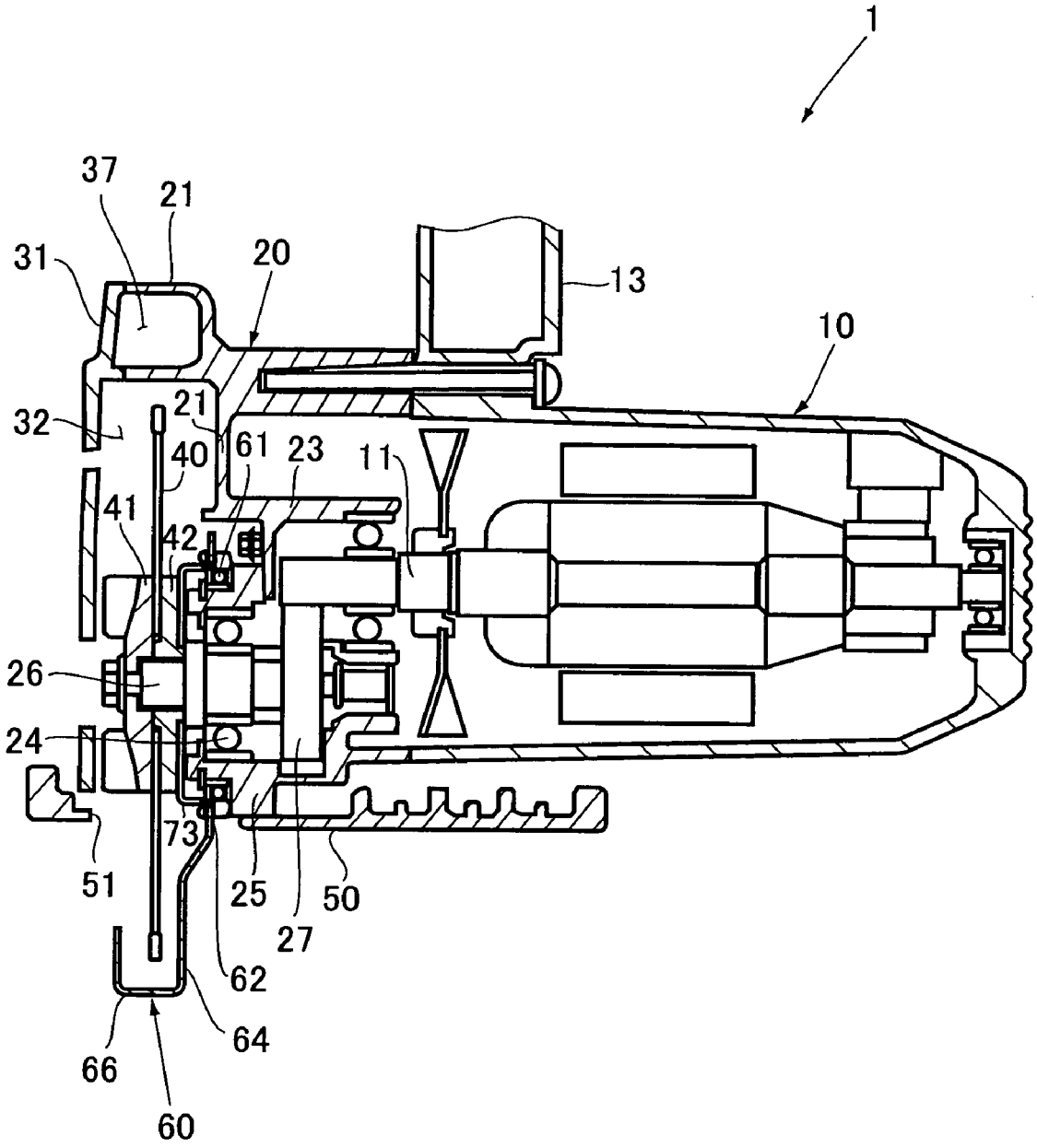
FIG. 2 is a sectional view of the glass-cutting apparatus.

Hereinafter, the preferred embodiments of the present invention are described in accordance with FIGS. 1 to 6. A glass-cutting apparatus of the present invention, as shown in FIGS. 1 and 2, comprises: a motor 10 extending sidewardly and having a driving shaft 11 protruding from a tip portion thereof; a top cover 20 attached to the driving shaft side of the motor 10 and having a shape like an inverted receptacle; a disc-like saw blade 40 rotatably held in the top cover 20; and a stabilizing plate 50 attached to a lower portion of the top cover 20 for allowing a lower portion of the saw blade to protrude therefrom by a predetermined length. At an upper portion of the motor 10, a handle grip portion 13 extending upward is formed. The driving shaft 11 of the motor 10 extends into a gear case 23 formed at a lower portion of the top cover 20 and extending sidewardly. The driving shaft 11 is engaged with a gear 27 attached to a spindle 26 which is axially held to a first ball bearing 24 installed in a bearing case 25 formed at a lower portion of the gear case 23, whereby the driving force of the motor 10 is transmitted to the spindle 26. At a tip portion of the spindle 26, the foregoing disc-like saw blade 40 extending downward and upward is fixed to the spindle 26, being sandwiched between a pair of fixed plates 41 and 42 provided at a base end of the blade 40.

Figure 3A:
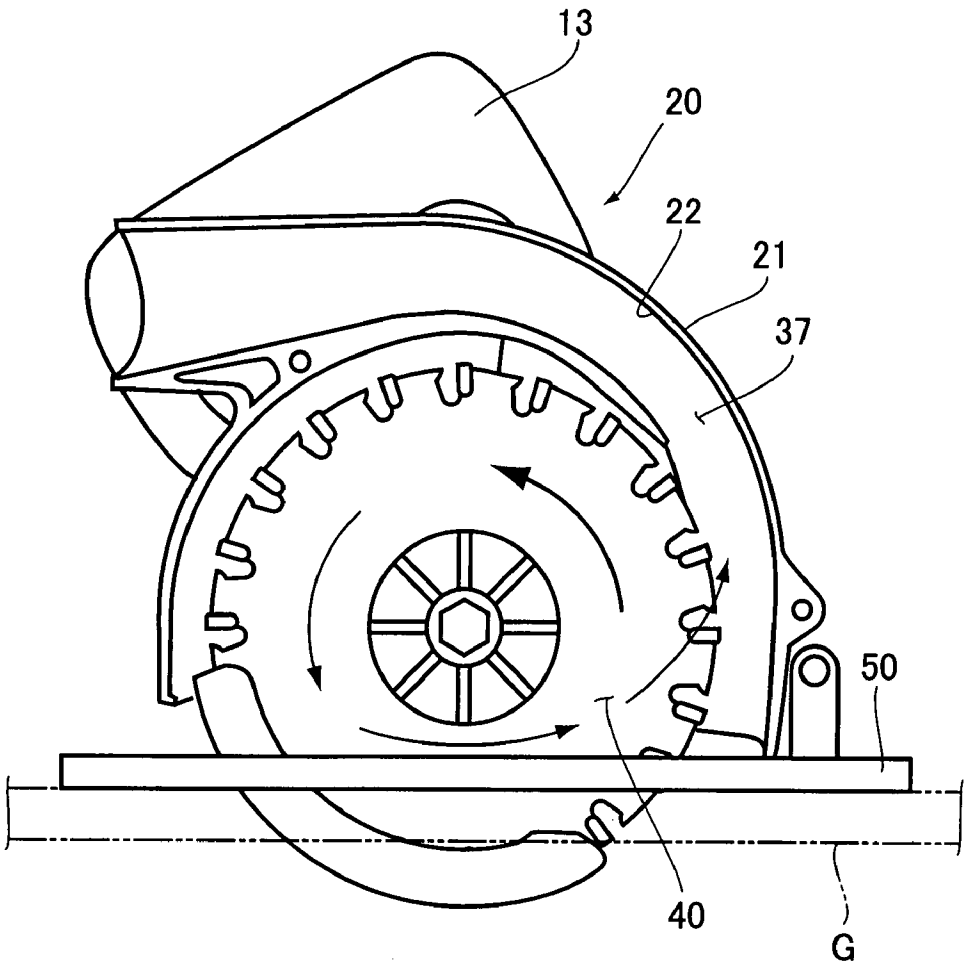
Figure 3B:
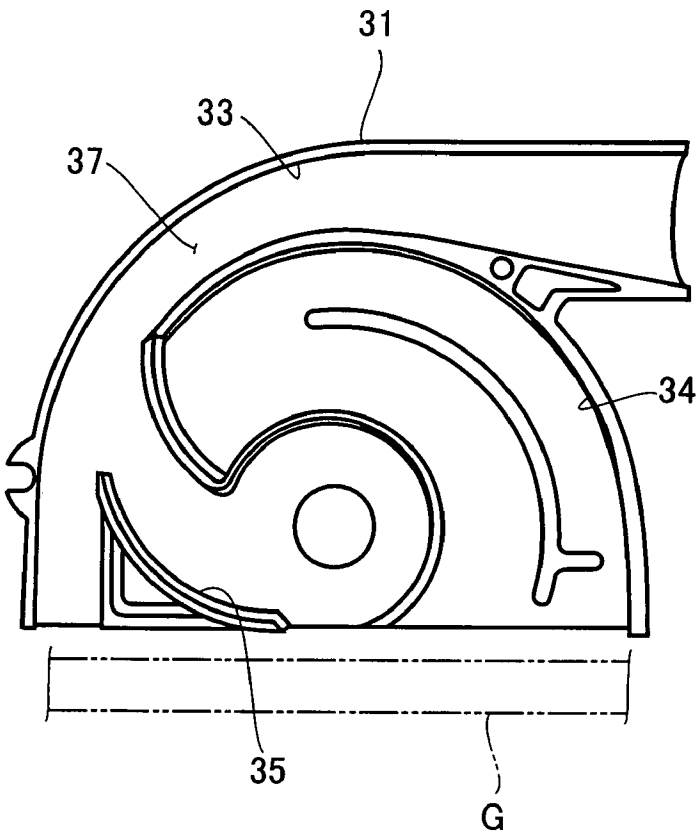

The top cover 20 comprises a blade case 21 which surrounds the upper portion of the saw blade 40, and a blade cover 31 connected thereto so as to contain the blade 40. The blade case 21 and the blade cover 31 are integrated with each other to have a space 32 of which lower portion is opened such that the saw blade 40 can rotate therein. At an upper portion of the blade case 21, as shown in FIG. 3A, in order to discharge fine particles generated from a glass being cut with the saw blade, there is formed with a concave portion 22 extending like an arc in a side view thereof. On the other hand, as shown in FIG. 3B, the blade cover 31 has a plurality of concave portions 33, 34, 35 extending along a rotational direction of the saw blade 40 as shown in FIG. 3A and formed like a spiral. The concave portion 33, which is formed at the uppermost portion in the blade cover 31, is similarly formed in an arc shape to the concave portion 22 provided in the blade case 21, as shown in FIG. 3A, so as to fit with each other. When the blade case 21 is integrated with the blade cover 31, both the portions form a discharge path 37 for sending out the glass fine particles as shown in FIGS. 1 and 2, which extends along a rotational direction of the blade 40. FIG. 3B illustrates a side view of the blade cover 31, which is separated from the blade case 21 and inverted.

As shown in FIG. 1, a stabilizing plate 50, which is attached to the lower portion of the top cover 20 integrally combined with both the blade case 21 and the blade cover 31, has a rectangular aperture 51 through which the lower portion of the saw blade 40 is allowed to protrude downward.

When a glass is cut by the saw blade 40 of the glass-cutting apparatus 1 with the foregoing structure, the generated glass fine particles flow in the same direction as the rotational direction of the saw blade 40, as shown in FIG. 3A, to pass through the discharge path 37. Then, the fine particles are sucked into a tube path, as shown in FIG. 1, coupled to the discharge path 37. In addition, the tip portion of the tube path 55 is connected with a suction unit (not shown).

As shown in FIG. 2, at an outside with respect to the rim of the saw blade 40, a fan-shaped safety cover 60 as seen from the front view is arranged. The safety cover 60 comprises: a connecting portion 62 to be axially supported on a second ball bearing 61 provided around the outer periphery of the bearing case 25 in which the first ball bearing 24 is included; a flank portion 64 connected with the tip portion of the connecting portion 62 and extending along the back face of the saw blade; and a covering portion 66 connected to the edge of the flank portion 64 and formed in a U-shape as seen from sides for covering the saw blade 40 at the outer periphery thereof. As shown in FIG. 4A, the second ball bearing 61 at the side of the motor abuts on a step portion 28 formed at the outer periphery of the bearing case 25 so that a movement of the second bearing 61 toward the side of the motor is restricted, while another edge on the side of the saw blade 40 abuts on a retaining ring 29 so that its movement toward the side of the saw blade 40 is also restricted. In the second ball bearing 61, an inside diameter of the outer ring 61*a* is just slightly smaller than a diameter of an upper face of the step portion 28. Thus, since a clearance between the outer ring 61*a* and the step portion 28 is very small, the fine particles generated in the glass cutting operation do not pass through the clearance. In a space 68 as formed between the inner and outer rings 61*b* and 61*a* of the second bearing 61, annular seal members 70, 70' are provided for sealing the space 68. Further detail about the seal members 70, 70' will be described later.

Figure 4A:
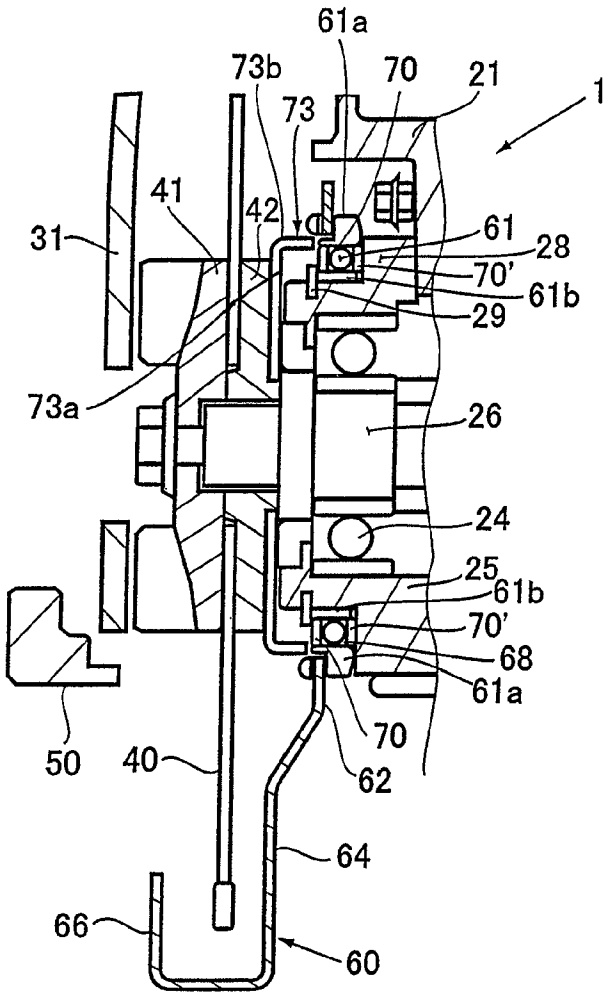
Figure 5A:
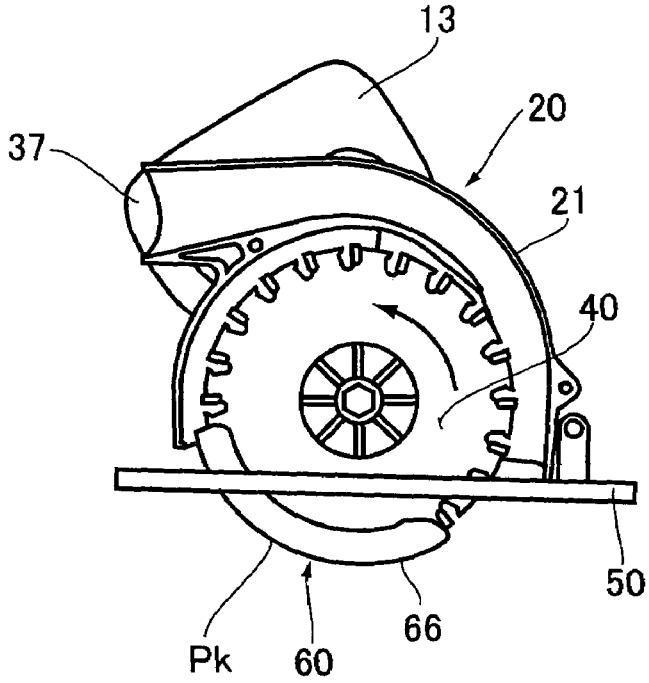

The cover 66 is, as shown in FIG. 5A, of an arc shape as seen from the front, and has a length to cover generally an overall area of the peripheral edge portion of the saw blade protruding downward from an underside of the stabilizing plate 50. At the flank portion 64 as shown in FIG. 4A, there is formed with a stick-like locking part (not shown) extending to the outside thereof. With the tip portion of the locking part, one end of a tension spring is locked, while another end of the tension spring is connected with the blade case 21 in a downstream of the discharge path 37. The tension spring operates to constantly pull the locking part to the side of another end as a supporting point. As a result, when an external force is not applied on the safety cover 60, the safety cover 60 automatically returns to a covering position Pk at which a covering portion 66 of the safety cover 60 covers the saw blade protruding from an underside of the stabilizing plate 50 downward. Further, on the blade cover 31 as shown in FIG. 1, there is provided with a stopper (not shown) which has an abutment with a side flat surface of the covering portion 66 for positioning the safety cover 60 in the covering position Pk.

Figure 5B:
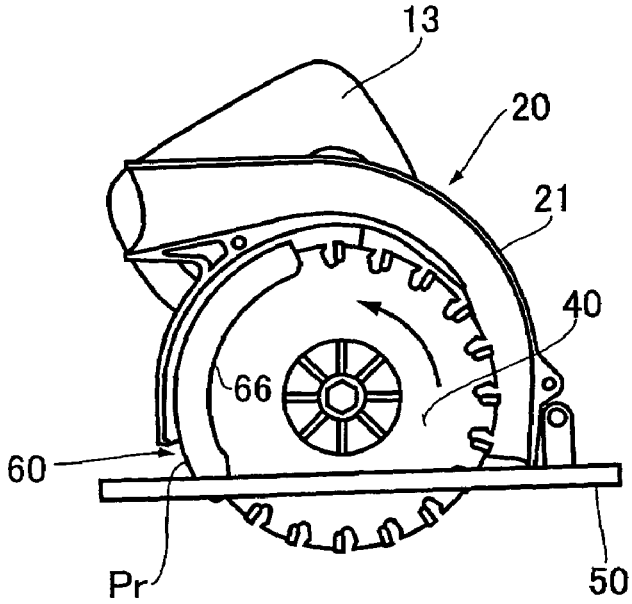

Under the operating condition of the apparatus 1, the tip portion of the covering portion 66 of the safety cover 60 abuts on the glass to resist a reaction force generated from the tension spring so that the safety cover 60 is swingably moved from the covering position Pk to a housing position Pr as shown in FIG. 5B. The housing position Pr is defined as a position of the safety cover 60 where the covering portion 66 is stored within the top cover 20 after moving to an upper position than that of the stabilizing plate 50.

Figure 6:
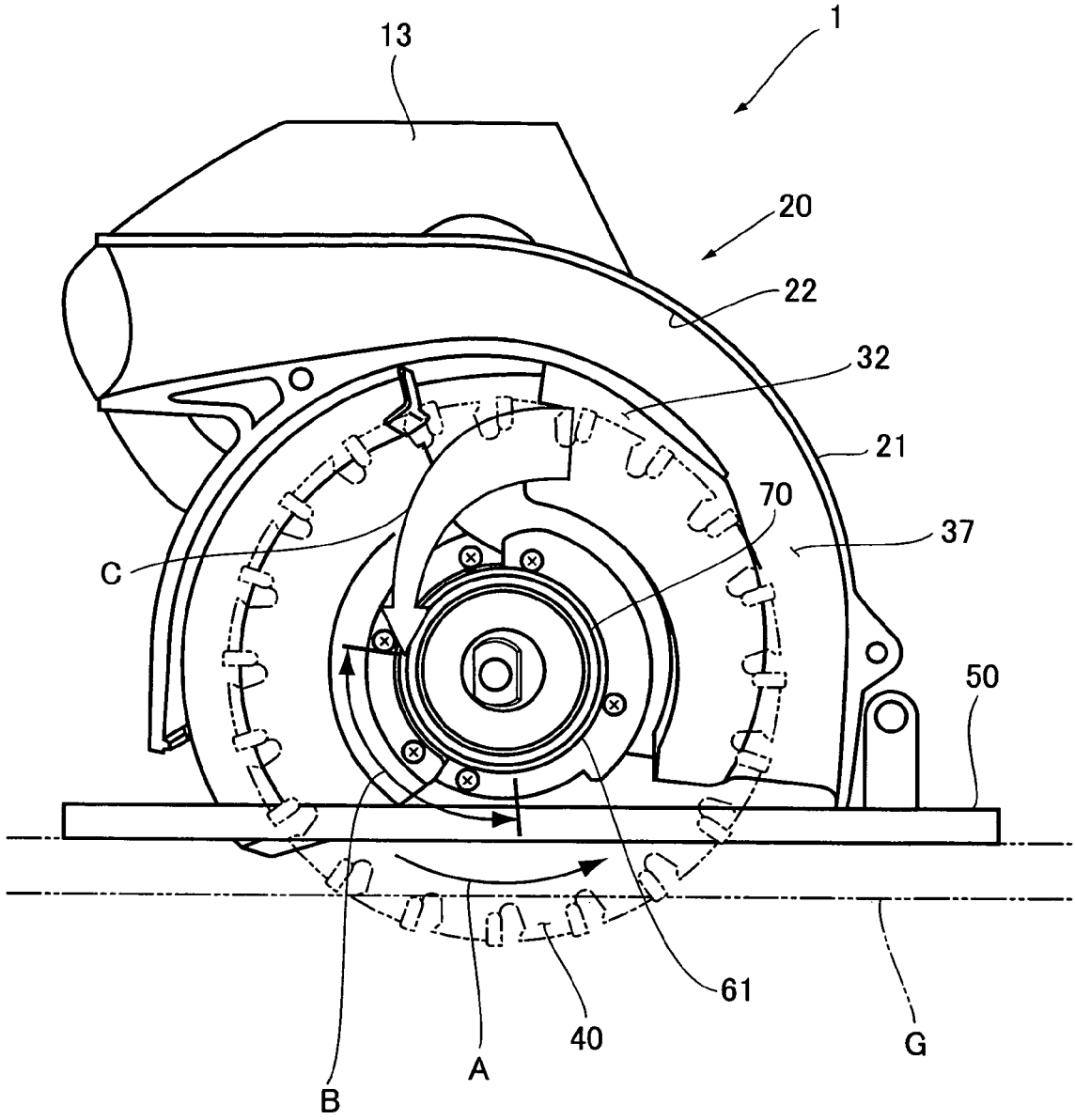
FIG. 6 is a front view of the case for blade, where in a passing flow direction of the glass fine particles to be passed in the glass-cutting apparatus is illustrated.

According to the glass-cutting apparatus 1 with such structure, when the saw blade 40 rotates in the direction of an arrow A as shown in FIG. 6, the glass fine particles enter upwardly into the space 32 of the top cover 20 through rotations of the saw blade 40, and then go downward along the concave portion 34 on the blade cover 31. At this time, since a glass G exists on the side of the downstream, the fine particles gather up together with sideward expansion. Therefore, the fine particles flowing around the area of the ball bearing 61 often collide against the seal member 70 on the side of the saw blade 40. As a result, there may occur abrasion of the seal member 70. Since the seal member 70' on the side of the motor as shown in FIG. 4A is blocked by both of the step portion 28 and the outer ring 61*a*, there is no danger that the fine particles may collide against the seal member 70. Thus, as shown in FIG. 4A, in order to cover the seal member 70 on the side of the saw blade 40, the fixed plate 42 between the saw blade 40 and the bearing case 25 is provided with a seal cover member 73 which is arranged approximately coaxially with the central rotational axis of the spindle 26.

The seal cover member 73 has a disc-like shape, and comprises a covering body section 73*a* extending upward and downward, a cover tip section 73*b* connected to a tip portion of the covering body section 73*a* so as to extend toward the seal member 70. A tip portion of the cover tip section is extended to around an outside of the outer periphery of the seal member 70, whereby the seal member 70 is covered with the seal cover member 73. Thus, even though the saw blade 40 rotates in the direction of the arrow A, as shown in FIG. 6, so that the glass fine particles pass the interior of the top cover 20 downwardly to proceed toward the second bearing 61, the particles are prevented from proceeding toward the seal member 70 by the seal cover member 73 as shown in FIG. 4A. Hence, the abrasion of the seal member 70 on the side of the saw blade 40 can be prevented from occurring. Further, it is not necessary that the seal cover member 73 is formed in a circular-ring shape. Rather, the seal cover member may be arranged only at a position which is greatly subjected to danger of collisions of the fine particles against the seal member as stated above, that is, in an area B having a predetermined length with respect to the circumferential direction in which the fine particles proceeding downward come into collision against the seal member 70.

Figure 4B:
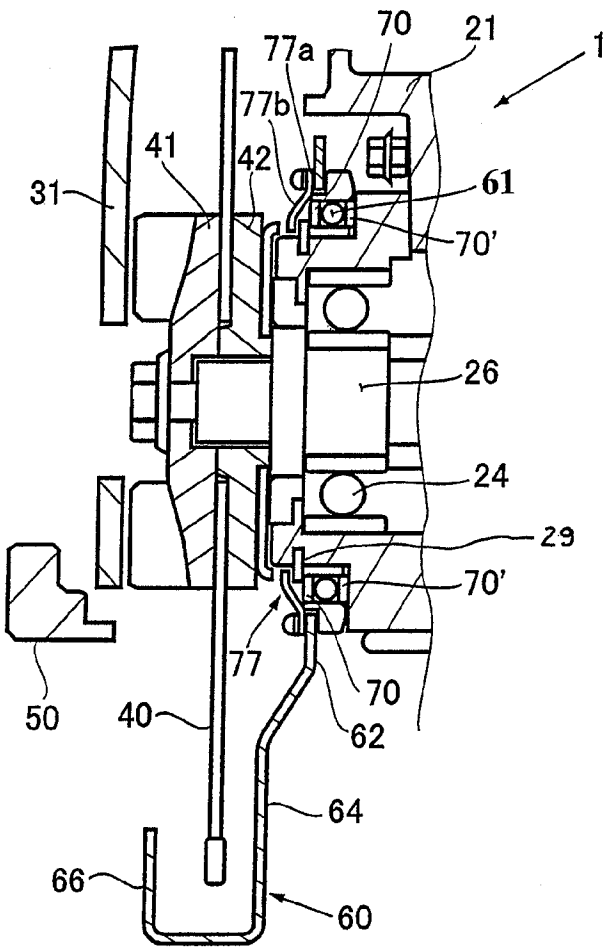
FIGS. 4A and 4B are sectional views of a seal cover member for the glass-cutting apparatus showing different embodiments each other.

Furthermore, as shown in FIG. 4B, the seal cover member 77 is of a circular-ring shape, and may comprise a connecting section 77*a* in which a circumferential edge thereof is connected to a fixing portion 62 by a fastening means such as screw, and a covering body section 77*b* connected with an inside of the connecting section 77*a* such that a tip portion of the covering body section 77*b* is extended to the position around an outside with respect to the inner periphery of the seal member 70. In other words, the tip portion of the covering body section 77*b* extends to a position around an outside with respect to the tip portion of a stopper ring 29 attached to the bearing case 25, and thereby the seal member 70 is covered with the seal cover member 77. Additionally, it is also unnecessary that the seal cover member as shown in FIG. 4B is formed in the circular ring shape. Rather, the seal cover member 77 as shown in FIG. 4B may be arranged in only an area B having a predetermined length with respect to the circumferential direction in which the fine particles proceeding downward, as shown by an arrow C in FIG. 6, come into collision against the seal member 70. With this structure, it is possible to obtain the same effect as the seal cover member 73 as shown in FIG. 4A.

Thus, since the glass-cutting apparatus 1 according to the present invention can prevent the abrasion of the seal member 70 from occurring, because of the seal cover member 73, 77, the seal member 70 is not hurt by the abrasion, namely no holes are made therein. Hence, it can be prevented that the fine particles intrude into the neighborhood of the second bearing 61 through the holes. This allows the safety cover to retain its swing constantly along the circumference of the blade 40. Therefore, at the time of non-operation in the glass-cutting apparatus 1, the safety cover 60 is adequately returned to the covering position Pk, as shown in FIG. 5 A, whereby it can be securely prevented that an operator touches by mistake on the saw blade 40 protruding from the underside of the stabilizing plate 50.

As stated above, according to the glass-cutting apparatus of the present invention, the safety cover is allowed to constantly swing through the bearing since the space on the side of the saw blade, which is formed between the inner and outer rings of the bearing, is sealed with the seal member in order to ensure the glass fine particles generated from the cutting operation not to intrude toward the bearing. Therefore, it becomes possible to retain constant free rotations of the bearing, to move the safety cover to the covering position reliably, and hence to prevent the situation that the operator touches the saw blade by mistake beforehand.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A glass-cutting apparatus having a saw blade rotatably held about a central rotatable shaft sidewardly extending to cut a glass, and a top cover for covering an upper portion of the saw blade, comprising:

a safety cover swinging about the central rotatable shaft sidewardly extending to move between a covering position for covering the saw blade downwardly protruding from a lower portion of the top cover, and a housing position for being received into said top cover, a body member connecting to said top cover, wherein said safety cover is mounted on a bearing disposed about said central rotatable shaft, and is permitted to swing through the bearing, wherein a clearance between inner and outer rings of said bearing on a side of the saw blade is sealed with a seal member, and wherein said inner ring of said bearing is connected to said body member; and said outer ring of said bearing is connected to said safety cover.

2. The glass-cutting apparatus according to claim 1, further comprising:

a seal cover member for covering said seal member in order to prevent fine particles generated from the glass to be cut from colliding against the seal member.

3. The glass-cutting apparatus according to claim 2, wherein said seal cover member comprises:

a disc-shaped covering body section provided between the bearing and the saw blade; and a cover tip section connected to an end of the covering body section and extending toward an outermost periphery of the seal member.

4. The glass-cutting apparatus according to claim 2, wherein said seal cover member comprises:

an attaching section being attached to said safety cover at a base end side of the seal cover member; and a covering body section extending toward an inside of said attaching section and toward an innermost periphery of the seal member.

5. The glass-cutting apparatus according to claim 2, wherein said seal cover member is arranged in at least an area having a predetermined circumferential length where said particles can collide against the seal member arranged to said bearing when the fine particles generated from the glass being cut by rotations of the saw blade proceed downward in said top cover.

6. The glass-cutting apparatus according to claim 1, wherein said bearing is a ball bearing.

7. A glass-cutting apparatus having a saw blade rotatably held and a top cover for covering an upper portion of the saw blade, comprising:

a body member connected to said top cover, a safety cover swinging to move between a covering position for covering the saw blade protruding from a lower portion of the top cover, and an operating position for operating the saw blade, wherein said safety cover is swingably mounted on a bearing, and a clearance between an inner ring of said bearing and an outer ring of said bearing on a side of the saw blade is sealed with a seal member, wherein said inner ring of said bearing and said outer ring of said bearing are relatively movable, and said inner ring of said bearing is connected to said body member; and said outer ring of said bearing is connected to said safety cover.

8. The glass-cutting apparatus according to claim 7, further comprising:

a seal cover member for covering said seal member in order to prevent fine particles generated from the glass to be cut from colliding against the seal member.

9. The glass-cutting apparatus according to claim 8, wherein said seal cover member comprises:

a disc-shaped covering body section provided between the bearing and the saw blade; and a cover tip section connected to an end of the covering body section and extending toward an outermost periphery of the seal member.

10. The glass-cutting apparatus according to claim 8, wherein said seal cover member comprises:

an attaching section being attached to said safety cover at a base end side of the seal cover member; and a covering body section extending toward an inside of said attaching section and toward an innermost periphery of the seal member.

11. He glass-cutting apparatus according to claim 8, wherein said seal cover member is arranged in at least an area having a predetermined circumferential length where said particles may collide against the seal member arranged to said bearing when the fine particles generated from the glass being cut by rotations of the saw blade proceed downward in said top cover.

12. The glass-cutting apparatus according to claim 7, wherein said bearing is a ball bearing.

* * * * *